United States Patent [19]

Busse

[11] Patent Number: 5,019,454

[45] Date of Patent: May 28, 1991

[54] POWDERS FOR PRODUCING HARD MATERIALS IN SHORT REACTION TIMES FOR FILLING HOLLOW WIRES FOR ELECTRIC ARC SPRAYING

[76] Inventor: Karl-Hermann Busse, Friedrichplatz 6, D-5900 Siegen-Geisweid, Fed. Rep. of Germany

[21] Appl. No.: 233,100

[22] Filed: Jul. 20, 1988

[30] Foreign Application Priority Data

Sep. 12, 1987 [DE] Fed. Rep. of Germany ..... 3730753

[51] Int. Cl.[5] ..... B22F 1/00

[52] U.S. Cl. ..... 428/570; 75/252; 75/254; 75/255

[58] Field of Search ..... 75/0.5 BB, 0.5 BC, 251, 75/252, 255, 254; 428/570

[56] References Cited

U.S. PATENT DOCUMENTS

| | | | |
|---|---|---|---|
| 3,719,519 | 3/1973 | Perugini | 75/252 |
| 3,881,911 | 5/1975 | Cheney et al. | 75/0.5 BC |
| 3,973,948 | 8/1976 | Laferty, Jr. et al. | 75/0.5 BB |
| 3,974,245 | 8/1976 | Cheney et al. | 75/0.5 BB |
| 4,395,279 | 7/1983 | Houck | 75/255 |
| 4,716,019 | 12/1987 | Houck et al. | 75/365 |
| 4,724,121 | 2/1988 | Weyand | 75/0.5 BC |

FOREIGN PATENT DOCUMENTS

| | | |
|---|---|---|
| 0118307 | 9/1984 | European Pat. Off. . |
| 2002472 | 7/1971 | Fed. Rep. of Germany . |

OTHER PUBLICATIONS

"A Simplified Model for Atmospheric Arc Spraying", *Second International Conference Surface Engineering,* Jun. 1987, 16–18, Paper 39, By K. Busse et al.

"Hard Surface Composite Coatings Produced by Arc Spraying", *Second International Conference Surface Engineering,* 1987, Paper 22, By S. Harris et al.

*Primary Examiner*—R. Dean
*Assistant Examiner*—David W. Schumaker
*Attorney, Agent, or Firm*—Young & Thompson

[57] ABSTRACT

Powders for producing hard materials in short reaction times are provided, especially for use in electric arc spraying. The powders are produced by bonding metallic and non-metallic starting materials to one another by spray-drying or agglomeration, using an organic or inorganic binder. The metallic starting materials are selected from the group consisting of Al, Ni, Ti, Cr, Mo, V, Zr and Ta, whereas the non-metallic starting materials are selected from the group consisting of $Cr_3C_2$, WC, C, SiC, $TiB_2$, $CrB_2$, $B_4C$, TiC, VC, TiN and $Si_3N_4$. In this manner, the metallic and non-metallic starting materials react exothermically during electric arc spraying to produce a hard substance.

2 Claims, 1 Drawing Sheet

Figure 1:
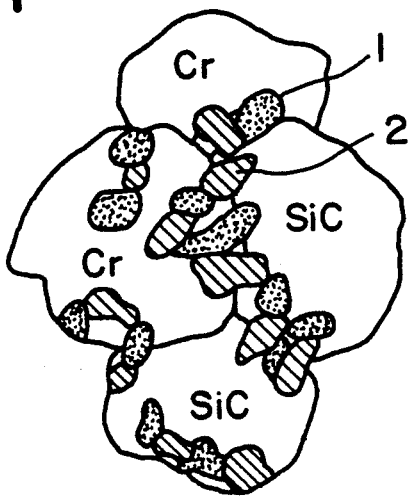

POWDERS FOR PRODUCING HARD MATERIALS IN SHORT REACTION TIMES FOR FILLING HOLLOW WIRES FOR ELECTRIC ARC SPRAYING

The invention relates to powders for producing hard materials in short reaction times, especially for filling hollow wires for electric arc spraying.

It is known that wearproof protective layers can be produced by arc spraying of cored wires (German Patent No. 2,002,472, European Patent No. 0 118 307).

However, in this connection, it is necessary either to produce the powders utilized for filling the hollow wires by atomizing in such a way that uniform burn-off by atmospheric oxygen takes place along the flight path of the sprayed particles and/or to fill the hollow wires with metallic and nonmetallic hard materials since during the brief flight times of the sprayed particles during arc spraying of about 1-10 ms (Symposium Issue "2nd Int. Conf. on Surface Engineering", England, 1987, Paper 39), as contrasted, for example, to cored wire welding where conditions close to equilibrium prevail, there occur only minor partial metallurgical reactions among the components of the filling (Symposium Issue "2nd Int. Conf. on Surface Engineering", England, 1987, Paper 22).

The invention is based on the problem of producing hard materials in the short reaction times available during electric arc spraying (from the melt-off point to the impingement of the particles on the substrate).

This object has been attained according to the invention by producing the powder utilized for filling the hollow wires by spray-drying or agglomeration of pulverulent metallic and/or nonmetallic starting materials with the use of organic or inorganic binders, so that high proportions of hard materials can form during the flight path of the sprayed particles—from the melt-off point to the substrate surface. Thereby the spacing (reaction path) between the pulverulent starting materials (reactants) is substantially reduced as compared with a loose powder mixture, and the reaction yield is increased. In order to additionally raise the temperature of the sprayed particles and thus to make the energy available that is required for the reaction, a portion of the pulverulent starting materials consists of exothermally reacting metals, such as Al, Ni, Ti, Cr, Mo, V, Zr, Ta. Another portion of the starting powder consists of metallic and nonmetallic hard materials, such as $Cr_3C_2$, SiC, $TiB_2$, $CrB_2$, $B_4C$, TiC, VC, TiN, $Si_3N_4$, WC, which are reacted to other hard materials during the particle flight. To further increase the energy available due to exothermal reaction, a portion of the pulverulent starting materials can furthermore consist of oxides reacting strongly exothermally with the metals Al, Ni, Ti, Cr, Mo, V, Zr, Ta, such as $Cr_2O_3$, $ZrO_2$, $TiO_2$, CoO, $Al_2O_3$ and $CeO_2$.

On account of the close bonding of the powdery starting materials by spray-drying and, respectively, agglomeration, the reaction path is minimized and, at the same time, the energy available for a metallurgical reaction to produce hard materials is significantly increased by the use of starting powders which react exothermally with one another. For this reason, a portion of the powder ca also be composed of low-reactive pulverulent prealloys based on ferrous and nonferrous compounds, such as FeCr, FeCrC, FeMo, CoB, MoNi, FeMn, FeW, FeNb, NiB, FeB, NbCr and/or carbon.

The advantages attained by this invention consist especially in that, starting with an economical starting powder, hard materials can be produced in short time periods.

It is thereby possible, for example, when using these powders prepared by spray-drying and/or agglomeration for filling hollow wires for arc spraying, to produce wearproof layers having high proportions of hard material.

Furthermore, on account of intensive reactions between the respective cored wire jacket and the powder filling, an improved bonding of the hard materials into the layers is achieved. Also, the layers produced in this way are more homogeneous and self-adhering, as compared with conventional layers. The spraying of expensive adhesive base coats is thus unnecessary.

One embodiment of the invention is illustrated in the drawing and will be described in greater detail below.

FIG. 1 shows by way of example a top view of a single powder produced by spray-drying and, respectively, agglomeration and composed for the filling of hollow wires for arc spraying.

The chromium particles and silicon carbide particles, bound by an alcohol, are coated superficially with aluminum and nickel particles.

Due to the high melt-off temperature during arc spraying and due to the short reaction paths resulting from the agglomeration, the chromium and silicon carbide particles react at the interfaces in correspondence with the following equation:

$$aCr + bSiC \rightarrow cSiC + dCr_xC_y + eSi \quad (1)$$

to chromium carbide.

On account of the strongly exothermal character of the reaction between nickel 1 and aluminum 2:

$$Ni + Al \rightarrow NiAl \quad (2)$$

the temperature of the sprayed particles is increased and cooling of the particles along the flight path due to radiation and convection is counteracted, i.e. the course of the reaction (1) is accelerated and enhanced.

Furthermore, due to the reaction of aluminum with excess silicon from reaction (1), a wearproof and corrosion-resistant matrix proportion of AlSi is produced in correspondence with the following reaction:

$$Al + Si \rightarrow AlSi. \quad (3)$$

Figure 2:
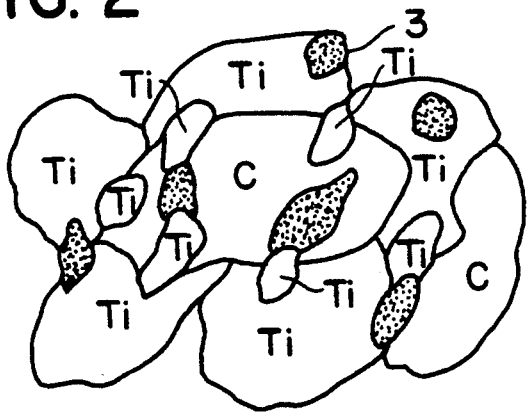

FIG. 2 shows in a top view a further example of a single powder produced by spray-drying and, respectively, agglomeration, composed for filling hollow wires for arc spraying.

The large titanium and graphite particles, bound by an alcohol, are coated superficially with small aluminum and titanium particles.

Along the flight path of the sprayed particles, the titanium and graphite particles react on the interfaces in correspondence with the following reaction:

$$aTi + bc \rightarrow cTiC \quad (4)$$

to yield titanium carbide.

Based on the exothermal reaction among the remaining titanium and aluminum particles 3:

$$aTi + bAl \rightarrow cTiAl_y \quad (5)$$

reaction of titanium and graphite to titanium carbide in accordance with equation (4) is promoted.

Figure 3:
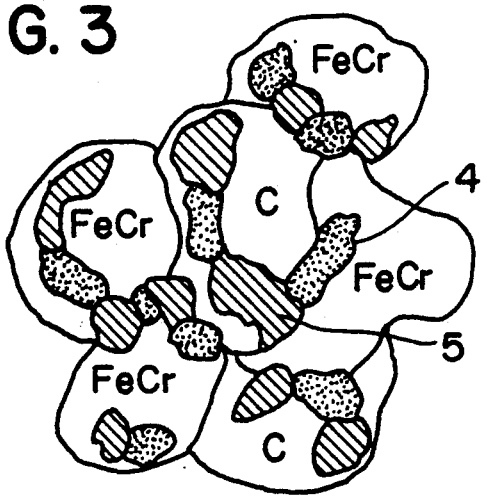

FIG. 3 shows in a top view a further example of a single powder particle composed for the filling of hollow wires for arc spraying and produced by spray-drying and, respectively, agglomeration.

The ferrochrome and graphite particles, bound with sodium silicate, are superficially coated with aluminum particles and chromium oxide particles. During the particle flight, first the ferrochrome particles react with the graphite particles in correspondence with the following reaction:

$$aFeCr + bC \rightarrow cCr_xC_y + dFe \quad (6)$$

to chromium carbide.

On account of the exothermal reaction between aluminum 4 and chromium oxide 5:

$$aAl + bCr_2O_3 \rightarrow cAl_2O_3 + dCr \quad (7)$$

the reaction (6) is accelerated in the same way as in case of the first example.

I claim:

1. Powders for producing hard materials in short reaction times, comprising granules of metallic and nonmetallic starting materials bonded to one another by spray-drying or agglomeration using organic or inorganic binders, said metallic starting materials being selected from the group consisting of Al, Ni, Ti, Cr, Mo, V, Zr and Ta and said nonmetallic starting materials being selected from the group consisting of $Cr_3C_2$, WC, C, SiC, $TiB_2$, $CrB_2$, $B_4C$, TiC, VC, TiN and $Si_3N_4$, whereby said metallic and non-metallic starting materials react exothermically during electric arc spraying to produce a hard substance, further comprising at least one member selected from the group consisting of $Cr_2O_3$, $ZrO_2$, $TiO_2$, CoO, $Al_2O_3$ and $CeO_2$.

2. Powders for producing hard materials in short reaction times, comprising granules of metallic and nonmetallic starting materials bonded to one another by spray-drying or agglomeration using organic or inorganic binders, said metallic starting materials being selected from the group consisting of Al, Ni, Ti, Cr, Mo, V, Zr and Ta and said nonmetallic starting materials being selected from the group consisting of $Cr_3C_2$, WC, C, SiC, $TiB_2$, $CrB_2$, $B_4C$, TiC, VC, TiN and $Si_3N_4$, whereby said metallic and non-metallic starting materials react exothermically during electric arc spraying to produce a hard substance, further comprising at least one member selected from the group consisting of FeCr, FeCrC, FeMo, MoNi, FeMn, FeW, CoB, FeNb, FeB, NbCr and NiB.

* * * * *